United States Patent [19]

Clanet et al.

[11] Patent Number: 4,877,156

[45] Date of Patent: Oct. 31, 1989

[54] COLLAPSIBLE AND INFLATABLE PISTON FOR TWO- OR MULTI- COMPARTMENTAL CONTAINER

[76] Inventors: Frank Clanet; Anne Dellerm, both of 4 bis Sentier des Voisinoux, 92190 Meudon-Bellevue, France

[21] Appl. No.: 132,634

[22] Filed: Dec. 9, 1987

Related U.S. Application Data

[63] Continuation of Ser. No. 884,636, Jul. 11, 1986, abandoned.

[30] Foreign Application Priority Data

Mar. 24, 1986 [FR] France ..... 86 04186

[51] Int. Cl.[4] ..... B67D 5/42

[52] U.S. Cl. ..... 222/386.5; 222/389

[56] References Cited

U.S. PATENT DOCUMENTS

| | | | |
|---|---|---|---|
| 3,255,936 | 6/1966 | Healy et al. | 222/389 |
| 3,362,589 | 1/1968 | Kinnavy | 222/389 |
| 3,381,863 | 5/1968 | Towns | 222/386.5 |
| 3,901,416 | 8/1975 | Schultz | 222/389 |
| 3,915,352 | 10/1975 | Scheindel | 222/389 |
| 3,997,124 | 11/1975 | Kifer | 222/386 |
| 4,023,717 | 5/1977 | Schultz | 222/386.5 |
| 4,109,833 | 8/1978 | Gross | 222/386.5 |
| 4,234,108 | 11/1980 | Diamond | 222/386 |
| 4,271,991 | 6/1981 | Diamond | 222/389 |
| 4,671,431 | 6/1987 | Obrist | 222/389 X |

OTHER PUBLICATIONS

*Plastics Materials;* Brydson, Whitefriars Press, 1966; P. 224.

*Primary Examiner*—Kevin P. Shaver
*Assistant Examiner*—Gregory L. Huson
*Attorney, Agent, or Firm*—Burns, Doane, Swecker & Mathis

[57] ABSTRACT

A collapsible and inflatable piston usable for containers and other receptacles for packaging requiring fluid-tight separation of the packaged product and the propellant by the piston, particularly for aerosol containers, the piston being formed from elastic material impermeable to gases and to liquids and includes a hollow cylindro-frustoconical vessel having a frustoconic cap closed at the top and extended by a cylindrical part open at the base. This cylindrical part has external sealing ribs mating a container in fluid-tight manner.

19 Claims, 1 Drawing Sheet

COLLAPSIBLE AND INFLATABLE PISTON FOR TWO- OR MULTI- COMPARTMENTAL CONTAINER

This application is a continuation, of application serial no. 884,636, filed July 11, 1986 and now abandoned.

BACKGROUND OF THE INVENTION

The present invention is in the field of packaging fluid-tight and impermeable barriers. It is directed more precisely to an inflatable and deformable piston, particularly for producing a fluid-tight impermeable barrier for a container, for example packages of the type for aerosols.

The technique of piston type containers in which a container, for example in monocompartmental aerosol packaging is converted into a two-compartment housing, is known, but until now, no realization thereof gave satisfaction due to the fact that complete fluid-tightness between the two compartments separated by the piston was not ensured. In the same way, the constructions of the prior art did not permit the introduction of the piston through the neck of the housing, considering that pistons used until then did not have the appropriate flexibility. In the more particular field of piston-type aerosol packages, there does not exist at present on the market any container or packaging capable of ensuring perfect fluidtightness between the two compartments, which limits the use of this technology and particularly its employment for aerosol packaging, to liquids or fluids of low viscosity or not wetting the walls of the piston and of the container. In fact, these pistons are formed of plastics material of little flexibility, the sealing between the two compartments, namely the compartment containing the product ant that containing the propellant gas, being ensured by the formation of a film of the product between the wall of the piston and that of the packaging container. Moreover, the plastics materials used are fairly permeable to the propellants or altered by humidity. It will also be noted that this films serving for the fluidtightness does not ensure the latter perfectly considering that it is more or less permeable to the propellant gases.

OBJECTS AND SUMMARY

It is an object of the present invention to produce a piston deformable and inflatable by the propellant gas enabling a container to be easily converted for example a single compartment aerosol container into a two-compartment container ensuring almost absolute fluidtightness between the compartment reserved for the product and that reserved for the propellant.

Another object of the invention is to provide an inflatable and deformable piston which can be introduced through the opening or the neck of the casing or container.

A further object of the invention is to provide an inflatable and deformable pistons so designed as to insure a proper fluid tightness between the two compartments without formation of a film of product or propellant between the piston and the container wall.

Yet another object of the invention is to provide an inflatable and deformable piston comprising sealing means which can be adapted to any asperities or lack in uniformity of the inner wall of the container or casing.

Accordingly, the present invention provides a collapsible and inflatable piston, particularly useful in containers and other receptacles for packaging, for example aerosol containers, requiring fluid-tight separation between the packaged product and the propellant agent by the piston, said piston being formed of an elastic material impermeable to gases and to liquids. This piston consists of a hollow vessel, having for example a cylindro-frustoconical shape, which is closed at one end and is extended at the other end by a cylindrical portion, forming a skirt, open at the base, said cylindrical portion having on its outer surface sealing means mating the inner wall of the container or receptacle in fluid-tight manner.

The collapsible and inflatable piston of the invention is constituted advantageously by a synthetic or natural elastomeric material, said elastomer having preferably a SHORE A hardness situated within the range of 40 to 65, for example 50.

In a preferred embodiment of the invention, the sealing means, produced preferably by molding with the piston, are constituted by a plurality of outer peripheral segments, each having for example a semi-toric shape, projecting on the cylindrical portion or skirt of the piston.

The invention extends also to all containers or receptacles, particularly aerosol containers, incorporating at least one piston according to the present invention.

Other advantages and characteristics of the invention will appear on reading the following description of a non-limiting embodiment of an inflatable or deformable piston according to the present invention.

DETAILED DESCRIPTION

Figure 1:
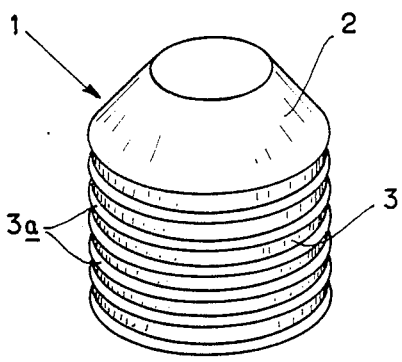
FIG. 1 is a perspective view of the collapsible and inflatable piston of the present invention.

As shown in FIG. 1, the collapsible and inflatable piston 1 is constituted by a dome-shaped element 2 of hollow frustoconical shape whose large base is extended by a cylindrical base or skirt 3 having a certain number of peripheral projections 3*a* regularly spaced and of semi-toric shape.

Figure 2:
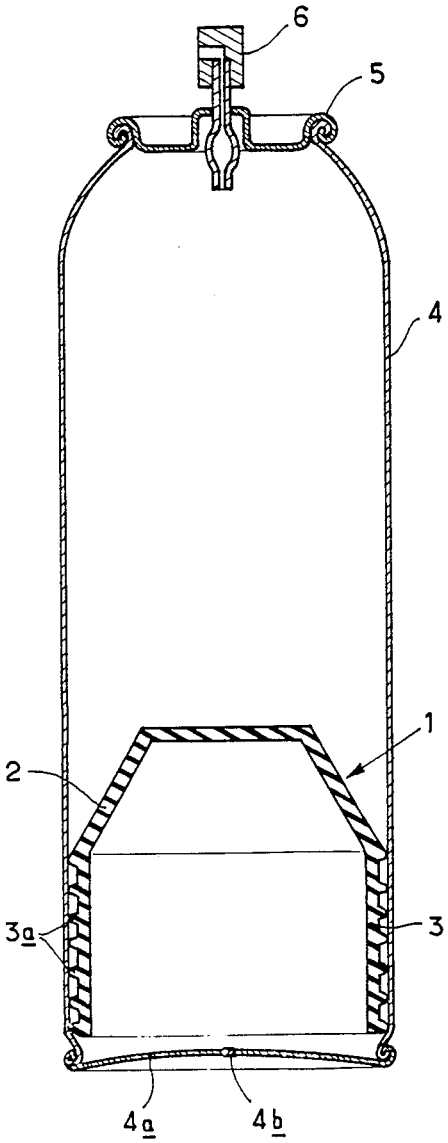
FIG. 2 is a sectional view on a larger scale of a flexible and inflatable piston according to the present invention mounted inside a container of the aerosol type.

As shown in FIG. 2, the collapsible piston 1 has been introduced through the opening of the neck of an aerosol container 4 so as to define, on the one hand, with the bottom 4*a* of the container 4 a first chamber containing the propellant gas and, on the other hand, with the cover 5 of the container 4, a second chamber containing the packaged product intended to be dispensed through a distributing valve 6. On the bottom 4*a* of the container 4 is provided a filler hole 4*b* for the propellant. The skirt 3 of piston 1 comes into sealing support through the segments 3*a* which bear against the inner wall of the container 4.

Figure 3:
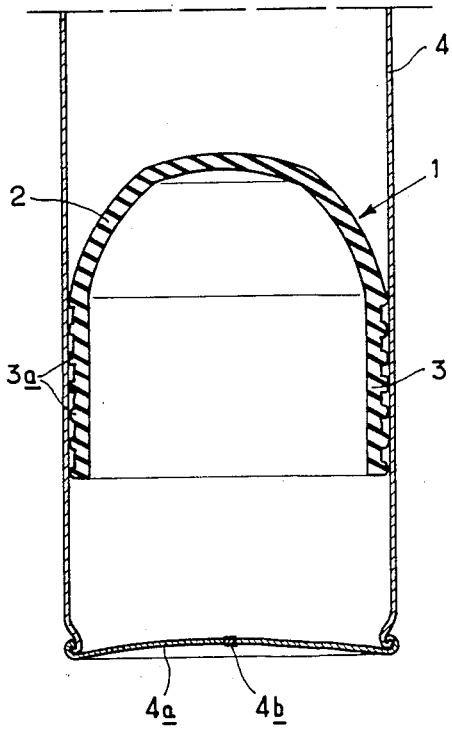
FIG. 3 is a sectional view of the piston of FIG. 2 in inflated position during an external distribution of packaged products.

As shown in FIG. 3, where the packaged product must be distributed, piston 1 is moved upward swelling so that the cone 2 takes the shape of a dome whilst the sealing segments 3*a* become squeezed through their crest against the wall of the container 4, thus ensuring almost absolute fluid-tightness between the propellant gas and the product to be packaged.

It is seen thus that, under the effect of sudden pressurization by a propellant or liquified gas, the skirt of the piston 1 inflates almost instantaneously like a balloon and is forcibly applied against the walls of the casing 4 through the sealing segments 3*a*. The inflation of the frustoconical cap has the added effect of creating a radially outward force on at least the uppermost sealing rib, urging the sealing rib against the inner surface of the container and insuring an excellent seal between the inner surface of the container and at least the uppermost sealing rib. Under these conditions, sealing is ensured due to the flexibility of the constituent elastomer which, even if the inner wall of the casing or can comprises defects of uniformity or irregularities of the surface, as is the case particularly for cans of welded sheet iron, comes into mating engagement with said defects the irregularities.

Before being inflated the piston is sufficiently rigid and adjusted to ensure a fluid-tight barrier between the compartment preserved for the product and that reserved for the propellant during filling, particularly if the product is liquid or fluid.

The introduction of the propellant gas must be effected very suddenly so as to inflate the skirt of the piston instantaneously. This introduction can be effected after an operation of heating the product for sterilization, for example, the piston ensuring suitable fluid-tightness preventing any exchange with the medium. In addition, after use, the pressure of the propellant gas must remain sufficient to keep the skirt applied against the wall of the container with sufficient force in order to maintain fluid-tightness. This final pressure must be of the order of 2.5 to $3\times10^5$ Pa and it is a function of the flexibility of said skirt.

On the other hand, the flexibility and thickness of the barrier elastomer used as well as the geometry of the piston enable its introduction, either into swaged cans before crimping of the dome or of the bottom, or through the neck of one-piece cans. The ratio of the diameters aperture/body of the piston must be comprised within the range of 0.7 to 1 (case of introduction by aspirating deformation).

In the general case, it is understood that the piston for ratios of diameters aperture/body less than 0.7, must be introduced during the manufacture of the two or multicompartmental can.

The advantage of the piston according to the present invention is that, for suitably selected ratios, it enables the manufacturer and aerosol packager to convert his monocompartmental containers or cans into two or multicompartmental packaging devices by introducing the one or more pistons through the aperture after having formed an orifice at the bottom of the can for the introduction of the propellant or for the production of vaccuum. Suitable tooling facilitates this insertion by forming a reduced pressure in the can and beneath the piston, which facilitates by aspiration its positioning in the body of the can.

Thus by the present invention the problem of fluid-tightness between the chambers of two- or multicompartmental containers becomes solved, due to the incorporation inside the cans or containers of at least one flexible and inflatable piston according to the invention.

It is clear that the invention is in no way limited to the embodiment described above with reference to the accompanying drawings, but it encompasses all modifications and variations derived from the same principle of construction. Thus if in the drawings the number of sealing segments 3*a* has been limited to seven, a value for which almost perfect fluid-tightness is ensured, this number of sealing segments is in no way limited.

What we claim is:

1. A collapsible and inflatable piston, particularly useful in containers for packaging requiring a fluid-tight separation between the packaged product and a propellant agent for said piston, comprising:

a hollow vessel having a frustoconical cap closed at one end and extended by a cylindrical portion open at the base, forming a skirt, said cylindrical portion having a plurality of external semi-toric sealing means for forming a seal in a fluid-tight manner with the inner wall of the container, the semi-toric sealing means closest to the frustoconical cap being located where said cap meets said cylindrical portion and is evenly integral to said cap, whereby when said piston inflates, radial forces act on said closest semi-toric sealing means in a radial direction so as to enhance the seal between the piston and the container, said piston being formed of an elastomeric material that is impermeable to gases and liquids.

2. The piston of claim 1, wherein the sealing means closest to the frustoconical cap is formed by an extension of said frustoconical cap extending radially beyond the cylindrical portion.

3. The collapsible and inflatable piston as set forth in claim 1, wherein the sealing means are molded integrally with the piston.

4. The collapsible and inflatable piston as set forth in claim 1 wherein the constitutive material of said piston is selected among the synthetic elastomeric materials and the natural elastomeric materials.

5. The collapsible and inflatable piston according to claim 4, wherein the elastomeric material has a Shore hardness A situated by the range of 40 to 65.

6. The collapsible and inflatable piston as set forth in claim 1, wherein the sealing means comprise a plurality of outer peripheral segments extending from the cylindrical portion.

7. The collapsible and inflatable piston as set forth in claim 6, wherein the outer peripheral segments have each a semi-toric shape.

8. The piston of claim 1, wherein each of said plurality of sealing means is evenly spaced along said cylindrical portion.

9. The piston of claim 8, wherein the sealing means closest to the frustoconical cap is formed by an extension of said frustoconical cap extending radially beyond the cylindrical portion.

10. The piston of claim 9, wherein one of said sealing means is located at the edge of the cylindrical portion opposite the frustoconical cap.

11. A collapsible and inflatable piston for use in a two-part container, comprising:

a cylindrical portion;

a plurality of parallel circumferential means extending from the cylindrical portion for forming a seal between the cylindrical portion and the inside of the two-part container;

a frustoconical cap closing off one end of said cylindrical portion, said cap having a truncated conical wall, the lower edge of said wall ending along the sealing plane of the seal forming means so as to form a seal forming rib, and a flat top completely closing off the conical wall in one plane, whereby when said piston inflates, radial forces act on said seal forming rib in a radial direction so as to enhance the seal between the piston and the container;

another end of said cylindrical portion being open;

said piston being comprised of an elastomeric materials;

the seal forming means being semi-toric in cross-section such that the width of the seal forming means, as measured in the axial direction of the piston, is widest at the cylindrical portion and tapers progressively to a smaller width at the portion of the seal forming means farthest away from the cylindrical portion.

12. The piston of claim 11, wherein each of said plurality of seal forming means is evenly spaced along said cylindrical portion.

13. The piston of claim 11, wherein one of said seal forming means is located at the edge of the cylindrical portion opposite the frustoconical cap.

14. The piston of claim 11, wherein the elastomeric material has a SHORE A hardness within the range of 40–65.

15. A collapsible and inflatable piston for use in a two-part container, comprising:

a cylindrical portion;

a plurality of parallel circumferential means extending from the cylindrical portion for forming a seal between the cylindrical portion and the inside of the two-part container, said radially outermost edge of said circumferential sealing means forming a sealing boundary that is concentric with and spaced radially outwardly from said cylindrical portion;

said circumferential seal forming means being evenly spaced along the entire axial length of the cylindrical portion;

a frustoconical cap closing off one end of said cylindrical portion, said cap having a truncated conical wall that extends radially outwardly beyond said cylindrical portion into said sealing boundary at the region where said truncated wall joins said cylindrical portion so as to form the circumferential seal forming means closest to said cap, whereby when said piston inflates, radial forces act on said closest seal forming means in a radial direction so as to enhance the seal between the piston and the container;

another end of said cylindrical portion being open;

one of said circumferential seal forming means being located at the edge of the cylindrical portion opposite the cap;

said piston being comprised of an elastomeric material;

each of said circumferential seal forming means being semitoric in cross section such that the width of the seal forming means, as measured in the axial direction of the piston, is widest at the cylindrical portion and tapers progressively to a smaller width at the portion of the seal forming means farthest away from the cylindrical portion.

16. The piston of claim 15, wherein there are seven circumferential seal forming means.

17. The piston of claim 15, wherein said cap has a flat top completely closing off the conical wall in one plane.

18. The piston of claim 15, wherein said elastomeric material has a SHORE A hardness within the range of 40 to 65.

19. The piston of claim 18, wherein there are seven circumferential seal forming means, and said cap has a flat top completely closing off the conical wall in one plane.

* * * * *